United States Patent [19]

van der Peyl

[11] 4,261,117

[45] Apr. 14, 1981

[54] DREDGING VESSEL

[75] Inventor: Jan C. van der Peyl, Bilthoven, Netherlands

[73] Assignee: DHV Raadgevend Ingenieursbureau BV, Netherlands

[21] Appl. No.: 6,035

[22] Filed: Jan. 24, 1979

[30] Foreign Application Priority Data

Feb. 10, 1978 [GB] United Kingdom ..... 5420/78

[51] Int. Cl.[3] ..... E02F 3/88

[52] U.S. Cl. ..... 37/58; 406/154; 406/161; 239/455

[58] Field of Search ..... 37/58, 72, 67, 56; 406/154, 157, 159, 160, 161; 239/455, 506, 513, 451

[56] References Cited

U.S. PATENT DOCUMENTS

| | | | |
|---|---|---|---|
| 576,250 | 2/1897 | Bates | 406/157 |
| 808,800 | 1/1906 | Wright | 37/58 X |
| 935,745 | 10/1909 | Dodge | 239/455 |
| 1,420,543 | 6/1922 | Hahn | 406/154 X |
| 2,926,437 | 3/1960 | Ellicott, Jr. | 37/72 |
| 2,927,424 | 3/1960 | Hyde | 239/455 X |
| 2,963,801 | 12/1960 | Ellicott, Jr. | 37/67 |
| 3,352,035 | 11/1967 | Joyce | 37/72 X |
| 4,026,049 | 5/1977 | Johnson | 37/72 X |

FOREIGN PATENT DOCUMENTS

| | | | |
|---|---|---|---|
| 941150 | 6/1948 | France | 37/58 |
| 581286 | 11/1977 | U.S.S.R. | 37/58 |

OTHER PUBLICATIONS

"Converted Tanker Opens Channel", *Construction Methods and Equipment*, Mar. 1960, pp. 171, 172, 174.

*Primary Examiner*—Clifford D. Crowder

*Attorney, Agent, or Firm*—Kane, Dalsimer, Kane, Sullivan and Kurucz

[57] ABSTRACT

A dredging vessel, specifically intended for the dredging of rivers or similar water courses, equipped with propulsion means allowing the vessel to move independently through the water; an adjustable suction line, with suction head, connected to the suction side of a pump installed in the vessel; and a discharge pipe, connected to the delivery side of the pump, rotatable about an approximately vertical axis and terminating in a nozzle with adjustable passage opening.

5 Claims, 4 Drawing Figures

DREDGING VESSEL

BACKGROUND OF THE INVENTION

The invention relates to a dredging vessel, specifically intended for the dredging of rivers or similar water courses.

SUMMARY OF THE INVENTION

It is an object of the present invention, to provide a dredging vessel that is particularly suitable for dredging shallow rivers and the like where the bed consists of good dredgeable material such as silt or sand.

It is a further object of the invention to construct a dredging vessel so that renewed sedimentation of the dredged fairway during the removal of the dredged matter is prevented in an efficient manner.

It is another object of the invention, to provide a dredging vessel that can carry out the dredging work in such a manner that the nuisance to shipping is reduced to a minimum.

It is still a further object of the invention to provide a dredging vessel that can dredge along a given path in an accurate manner.

To this purpose, according to the invention the dredging vessel is equipped with propulsion means allowing the vessel to move independently through the water; an adjustable suction line, with suction head, connected to the suction side of a pump installed in the vessel; and a discharge pipe, connected to the delivery side of the pump, rotatable about an approximately vertical axis and terminating in a nozzle with adjustable passage opening.

The dredged material is discharged continuously at a sufficient distance to prevent renewed sedimentation of the dredged fairway. The distance can be regulated by adjusting the aperture of the nozzle.

As the vessel moves while dredging and does not make use of a stationary floating discharge pipe, shipping is scarcely hampered by the dredging work.

BRIEF DESCRIPTION OF THE DRAWINGS

The invention is further described with reference to the drawings, which show an embodiment of the dredging vessel according to the invention.

DESCRIPTION OF A PREFERRED EMBODIMENT

Figure 1:
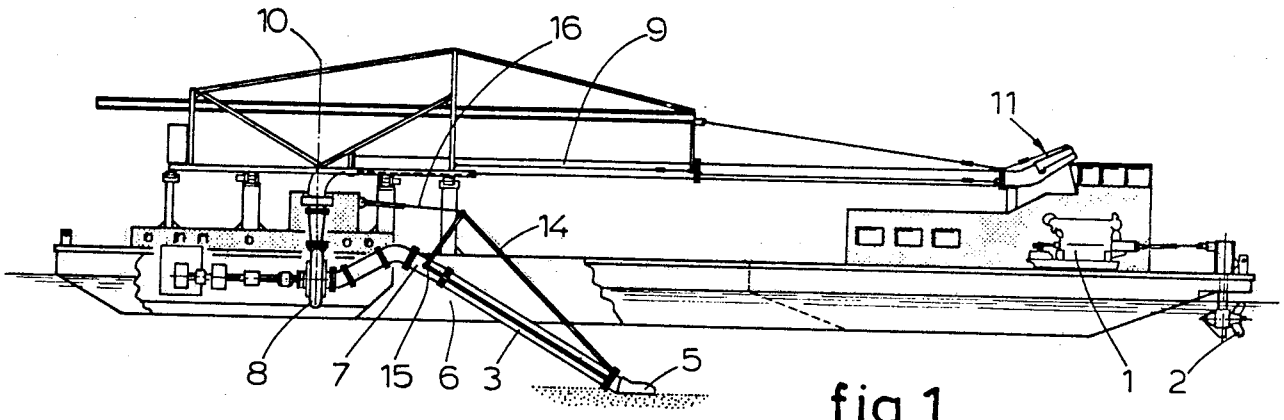
FIG. 1 is a side view of a dredging vessel according to the invention.
Figure 2:
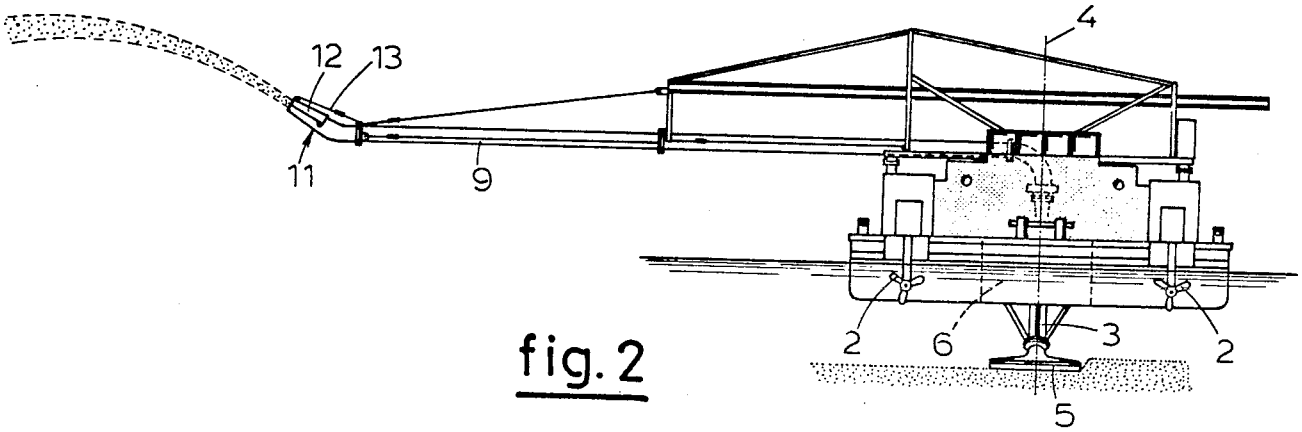
FIG. 2 is a rear view of the dredging vessel shown in FIG. 1.
Figure 4:
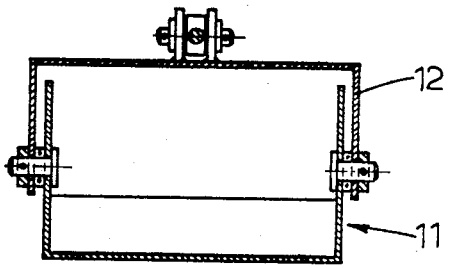
FIG. 4 is a cross-section of the discharge valve taken along the line 4—4 of FIG. 3.
Figure 3:
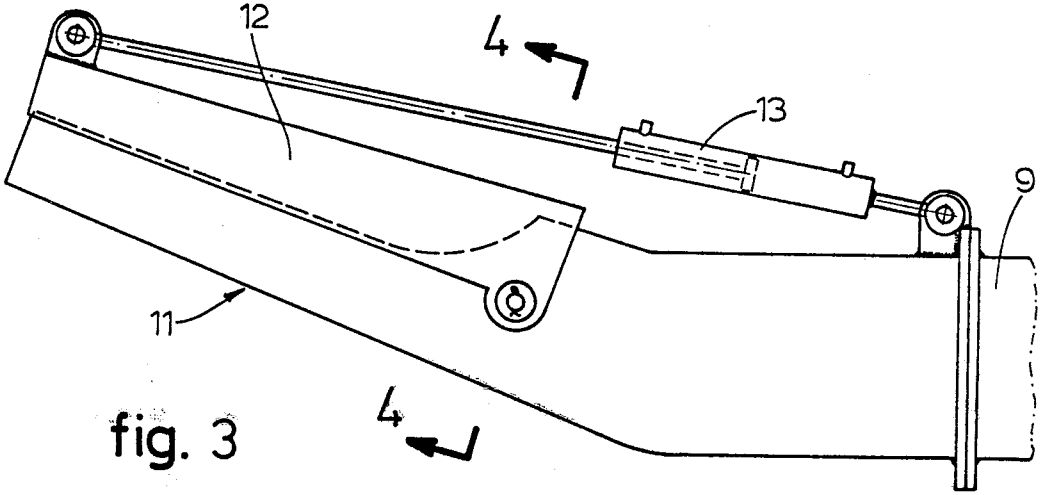
FIG. 3 is a side elevation of the discharge nozzle on an enlarged scale.

The drawings show a dredging vessel which is specifically designed for dredging shallow rivers.

This dredging vessel is provided with propellers 2, also serving as a rudder, and driven by an engine 1. These propellers 2 allow the dredging vessel to move independently through the water. The dredging vessel is further equipped with a suction line 3 which extends into the central vertical longitudinal plane 4 of the vessel. This pipe ends in a suction head 5 which drags over the river bed.

The rigid suction line 3 runs from the suction head 5 upwards through a central opening 6 in the vessel and is connected, by a flexible connecting piece 7 and other pipe parts, to the suction side of a pump 8 mounted in the vessel. This pump 8 is operated by a separate drive means.

A discharge pipe 9 is connected to the delivery side of the pump 8. The pipe 9 is rotatable about an approximately vertical axis 10 which is supported by the vessel.

The discharge pipe 9 is fitted with a nozzle 11 which passage opening is adjustable by means of a valve 12. The valve 12 can be adjusted by remote control attained in the example shown in the drawings by means of a hydraulically operated cylinder-piston unit 13, hinged on one side to the valve 12 and on the other side to the discharge pipe 9.

The discharge pipe 9 can be positioned approximately horizontally, as shown in the drawings with its nozzle 11 slanting upwards. However the pipe 9 itself can also be slanted slightly upwards so that the disposal distance of the dredged material is increased. The disposal distance can then be further regulated by adjusting the valve 12.

The suction line 3 which, when viewed from the navigating direction, runs diagonally backwards and downwards is fixed to a rigid supporting frame 14 and is rotatable about a horizontal axis 15 which is supported by the vessel. The supporting frame 14 can be pivoted, together with the suction line 3, by a hydraulically operated cylinder-piston unit 16 which is hinged on one side to the supporting frame 14 and on the other side to a fixed point on the vessel.

This cylinder-piston unit 16 not only allows the angle of the suction line 3 to be adjusted but is also used to adjust the pressure of the suction head 5 on the river bed.

Preferably, the dredging vessel is approximately 30 m long and 10 m wide, with a draught of 1–1.25 m and with a dredging depth of 2–6 m. The discharge pipe 9 of the dredging vessel has a length of approximately 16–20 m.

If necessary, the vessel may be constructed with ballast tanks, to counterbalance the discharge pipe 9 when this pipe extends in a transverse direction.

The invention is not restricted to the example shown in the drawings, which may be varied in several ways within the scope of the appended claims.

I claim:

1. A dredging vessel, specifically intended for the dredging of rivers or similar water courses, equipped with propulsion means allowing the vessel to move independently through the water; an adjustable suction line, with suction head, connected to the suction side of a pump installed in the vessel, said suction line extending into the central vertical longitudinal plane of the vessel and being fixed to a rigid supporting frame which can be pivoted about a horizontal axis by means of a hydraulically operated cylinder-piston unit, which is coupled to the supporting frame by a hinge construction and by which the pressure of the suction head on the bed is adjustable; and a discharge pipe, connected to the delivery side of the pump, rotatable about an approximately vertical axis and terminating in a nozzle with adjustable passage opening, said nozzle being inclined upwards with respect to said discharge pipe.

2. A dredging vessel as claimed in claim 1, wherein the nozzle is fitted with an adjustable valve.

3. A dredging vessel as claimed in claim 2, wherein the valve is adjusted by remote control.

4. A dredging vessel as claimed in claim 1, wherein the vessel has a length of approximately 30 m and a width of approximately 10 m, while the draught of the vessel is approximately 1–1.25 m and the dredging depth is approximately 2–6 m.

5. A dredging vessel as claimed in claim 4, wherein the discharge pipe has a length of approximately 16–20 m.

* * * * *